US011231672B2

(12) United States Patent
Suzuki

(10) Patent No.: US 11,231,672 B2
(45) Date of Patent: Jan. 25, 2022

(54) IMAGE FORMING APPARATUS

(71) Applicant: CANON KABUSHIKI KAISHA, Tokyo (JP)

(72) Inventor: Masato Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 16/135,699

(22) Filed: Sep. 19, 2018

(65) Prior Publication Data

US 2019/0092592 A1 Mar. 28, 2019

(30) Foreign Application Priority Data

Sep. 28, 2017 (JP) ..... JP2017-189101
Aug. 7, 2018 (JP) ..... JP2018-148583

(51) Int. Cl.
*G03G 15/00* (2006.01)
*G03G 21/00* (2006.01)
(Continued)

(52) U.S. Cl.
CPC ..... *G03G 15/5029* (2013.01); *B65H 5/062* (2013.01); *B65H 5/068* (2013.01); *B65H 7/14* (2013.01); *B65H 7/20* (2013.01); *G03G 15/6502* (2013.01); *B65H 2402/24* (2013.01); *B65H 2404/152* (2013.01); *B65H 2511/22* (2013.01); *B65H 2511/51* (2013.01); *B65H 2513/108* (2013.01); *B65H 2553/61* (2013.01); *G03G 15/6558* (2013.01); *G03G 2215/00945* (2013.01)

(58) Field of Classification Search
None
See application file for complete search history.

(56) References Cited

U.S. PATENT DOCUMENTS 4,693,010 A * 9/1987 Sills ..... B65H 7/125 33/501.03
2012/0057893 A1* 3/2012 Sahara ..... G03G 15/657 399/67

(Continued)

FOREIGN PATENT DOCUMENTS

JP 01176746 A * 7/1989
JP 2535365 A 9/1996

(Continued)

*Primary Examiner* — Jill E Culler
*Assistant Examiner* — Ruben C Parco, Jr.
(74) *Attorney, Agent, or Firm* — Canon U.S.A., Inc. I.P. Division

(57) ABSTRACT

An image forming apparatus includes a flag, a sensor, a loop controller, a detector, and an image controller. The flag is disposed between the first and second conveying units and moves when in contact with a recording material having a loop. A signal value output from the sensor varies per a flag position. The loop controller changes a recording material speed based on the signal value output. The detector detects the recording material or an image formed on the recording material and the image controller changes an image forming condition based on the detection. The detector includes first and second contacting members that move to nip the recording material. A position of the flag, for changing a signal value output from the sensor, is included in a range in which first and second contacting members are movable.

15 Claims, 11 Drawing Sheets

(51) Int. Cl.

| | |
|---|---|
| ***B65H 7/20*** | (2006.01) |
| ***B65H 5/06*** | (2006.01) |
| ***B65H 7/14*** | (2006.01) |

(56) References Cited

U.S. PATENT DOCUMENTS

| | | | | |
|---|---|---|---|---|
| 2015/0071660 | A1* | 3/2015 | Yamashina | G03G 15/55 399/45 |
| 2016/0152052 | A1* | 6/2016 | Namiki | G01N 29/11 73/602 |

FOREIGN PATENT DOCUMENTS

| | | | | |
|---|---|---|---|---|
| JP | 2002362776 | A | | 12/2002 |
| JP | 2006030736 | A | | 2/2006 |
| JP | 2014182153 | A | | 9/2014 |
| JP | 2015009964 | A | * | 1/2015 |

* cited by examiner

IMAGE FORMING APPARATUS

BACKGROUND

Field of the Disclosure

The present disclosure relates to an image forming apparatus, such as a copier or a printer.

Description of Related Art

General image forming apparatuses, such as a copier and a printer, perform loop control such that an amount of loop of a sheet formed between two conveying units is detected by a loop sensor and a conveying speed of sheets by the conveying units is changed in accordance with the detected loop amount.

Japanese Patent No. 2535365 discloses loop control performed in a position between a registration roller pair which synchronously conveys a sheet and an image forming unit. According to Japanese Patent No. 2535365, if an image forming apparatus determines that an amount of loop of a sheet formed between the registration roller pair and the image forming unit is small, a conveying speed of the sheet by the registration roller pair is increased. When it is determined that the amount of loop of the sheet is large, the conveying speed of the sheet by the registration roller pair is reduced.

On the other hand, an image forming apparatus which includes a sensor (hereinafter referred to as a "medium sensor") which determine a type of sheet between a registration roller pair and an image forming unit and which changes an image forming condition in accordance with a type of sheet detected by the medium sensor is widely used.

Japanese Patent Laid-Open No. 2006-30736 discloses a medium sensor which includes a light emitting element which emits light to a surface of a sheet and a photodiode which receives light reflected by the surface of the sheet. Here, according to Japanese Patent Laid-Open No. 2006-30736, a press member which presses a sheet relative to a guide surface on which the sensor is in contact with the sheet is disposed so that adaptability of the medium sensor relative to the sheet is enhanced. The press member is connected to a spring and presses the sheet by an urging force of the spring. By this, the sheet is prevented from being separated from the guide surface due to conveyance flapping, and accordingly, degradation of accuracy of a determination of a type of sheet is prevented.

In a case where the loop sensor and the medium sensor described above are disposed between the registration roller pair and the image forming unit, the sheet is pressed on the guide surface by the spring disposed on the medium sensor, and therefore, orientation of the sheet is corrected. Therefore, it is difficult for the loop sensor to detect an amount of loop of the sheet, and accordingly, the loop control may not be executed with high accuracy.

SUMMARY

The present disclosure provides execution of loop control with high accuracy between two conveying units and suppresses degradation of accuracy of detection of a sheet by a sensor which is different from the loop sensor disposed between the two conveying units.

According to an aspect of the present disclosure, an image forming apparatus includes a first conveying unit configured to convey a recording material, a second conveying unit configured to convey the recording material, a flag disposed between the first and second conveying units and configured to be moved in a case where the flag is in contact with a recording material having a loop formed between the first and second conveying units, a sensor configured to output a signal of an output value which varies depending on a position of the flag, a loop controller configured to change a speed of conveyance of the recording material conveyed by at least one of the first and second conveying units in accordance with the signal output from the sensor, a detector disposed between the first and second conveying units and configured to detect the recording material or an image formed on the recording material, and an image controller configured to change, in accordance with a result of the detection performed by the detector, an image forming condition to form an image on the recording material, wherein the detector includes a first contacting member configured to contact with one of surfaces of the recording material and a second contacting member configured to contact with the other of the surfaces of the recording material which face each other to nip the recording material and further includes a first urging member configured to urge the first contacting member to the second contacting member and a second urging member configured to urge the second contacting member to the first contacting member, and wherein the first and second contacting members are movable in a direction in which the first and second contacting members nip the recording material, and a position of the flag for changing an output value of a signal output from the sensor is included in a range in which the first and second contacting members are movable when viewed in a direction which is orthogonal to the direction in which the first and second contacting members are movable and which is orthogonal to a conveying direction of the recording material.

Further features of the present disclosure will become apparent from the following description of embodiments with reference to the attached drawings.

DESCRIPTION OF THE EMBODIMENTS

First Embodiment

Figure 1:
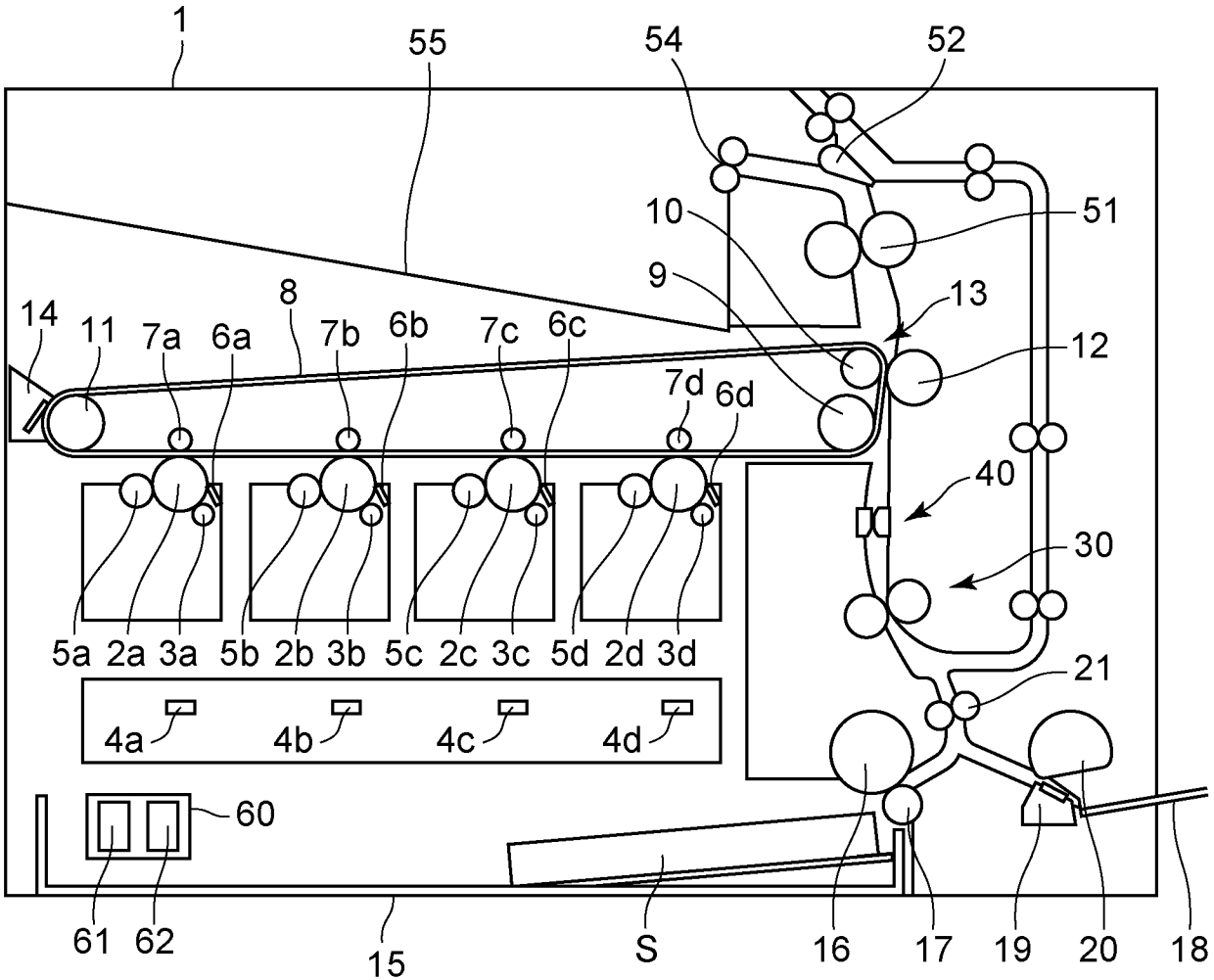
FIG. 1 is a cross-sectional view schematically illustrating a configuration of an image forming apparatus.

A configuration of an image forming apparatus according to a first embodiment will be described with reference to FIG. 1. In this embodiment, a color laser beam printer 1 of an electrophotographic method (hereinafter referred to as a "printer 1") is illustrated as the image forming apparatus.

The printer 1 includes four image bearing members of a drum shape which are substantially arranged in parallel in a substantially horizontal direction, that is, photoconductive drums 2 (2*a* to 2*d*). The photoconductive drums 2 are driven to be rotated in a clockwise direction in FIG. 1 by driving sources not illustrated. The printer 1 further includes charge units 3 (3*a* to 3*d*) which uniformly charge surfaces of the photoconductive drums 2 and scanner units 4 (4*a* to 4*d*) which form electrostatic latent images on the corresponding photoconductive drums 2 by emitting a laser beam based on image information. The printer 1 further includes developing units 5 (5*a* to 5*d*) which perform development by attaching toner to the electrostatic latent images to obtain images and cleaning units 6 (6*a* to 6*d*) which remove toner which remains on the surfaces of the photoconductive drums 2 after the images are transferred on an intermediate transfer belt 8. The photoconductive drums 2, the charge units 3, the developing units 5, and the cleaning units 6 are configured as integrated cartridge units, and the different cartridge units form different images of different colors yellow, cyan, magenta, and black).

Primary transfer rollers 7 (7*a* to 7*d*) are in contact with the respective photoconductive drums 2 through the intermediate transfer belt 8 and toner images on the photoconductive drums 2 are transferred on the intermediate transfer belt 8 by the primary transfer rollers 7. The intermediate transfer belt 8 is stretched by a driving roller 9, a secondary transfer counter roller 10, and a tension roller 11 and is rotated by the driving roller 9 in a counterclockwise direction in FIG. 1. A secondary transfer roller 12 (a transfer unit) disposed in a position facing the secondary transfer counter roller 10 through the intermediate transfer belt 8 transfers a toner image transferred on the intermediate transfer belt 8 to a sheet S. The intermediate transfer belt 8, the secondary transfer counter roller 10, and the secondary transfer roller 12 constitute a secondary transfer conveying unit 13 which conveys the sheet S and have a function of performing transfer on the sheet S and also a function of conveying the sheet S to a downstream side. Furthermore, a belt cleaning unit 14 disposed in a position facing the tension roller 11 through the intermediate transfer belt 8 removes and collects toner remaining on a surface of the intermediate transfer belt 8.

The printer 1 includes a sheet feeding cassette 15 and a multi-tray 18 on which sheets S (recording materials) are to be placed. The sheets S placed on the sheet feeding cassette 15 are separated one-by-one by a sheet feeding roller 16 and a separation roller 17 and supplied to a drawing roller 21. The sheets S placed on the multi-tray 18 are separated one-by-one by a multi sheet feeding roller 20 and a separation pad 19 and supplied to the drawing roller 21. Each of the sheets S supplied to the drawing roller 21 is conveyed to a registration roller pair 30 which corrects skew of the sheets S. A sensor guide unit 40 which detects information on characteristics of the sheets S is disposed on a conveying path between the registration roller pair 30 and the secondary transfer roller 12 to determine a type of the sheets S. The sensor guide unit 40 will be described in detail hereinafter.

A fixing unit 51 fixes an image transferred on a sheet S by the secondary transfer roller 12 on the sheet S. The fixing unit 51 fixes the image on the sheet S by applying heat and pressure on the sheet S. The sheet S is guided to a sheet discharge conveying path by a flapper 52 when one-side printing is performed, whereas the sheet S is guided to a reverse conveying path and a duplex conveying path by the flapper 52 when both-side printing is performed. A sheet discharge roller pair 54 discharges the sheet S conveyed to the sheet discharge conveying path to a sheet discharge tray 55.

A controller 60 is constituted by a circuit, such as a central processing unit (CPU), a read only memory (ROM), and a random access memory (RAM), not illustrated, and executes programs for controlling the devices included in the printer 1. The controller 60 includes a conveyance controller 61 and an image controller 62 as functions. The conveyance controller 61 controls a driving motor, described below, to change a conveying speed of the sheet S. The image controller 62 determines a type of sheet S based on information on the sheet S obtained from the sensor guide unit 40 and changes an image forming condition of the image forming unit in accordance with the determined type. The functions will be described in detail hereinafter.

Figure 2:
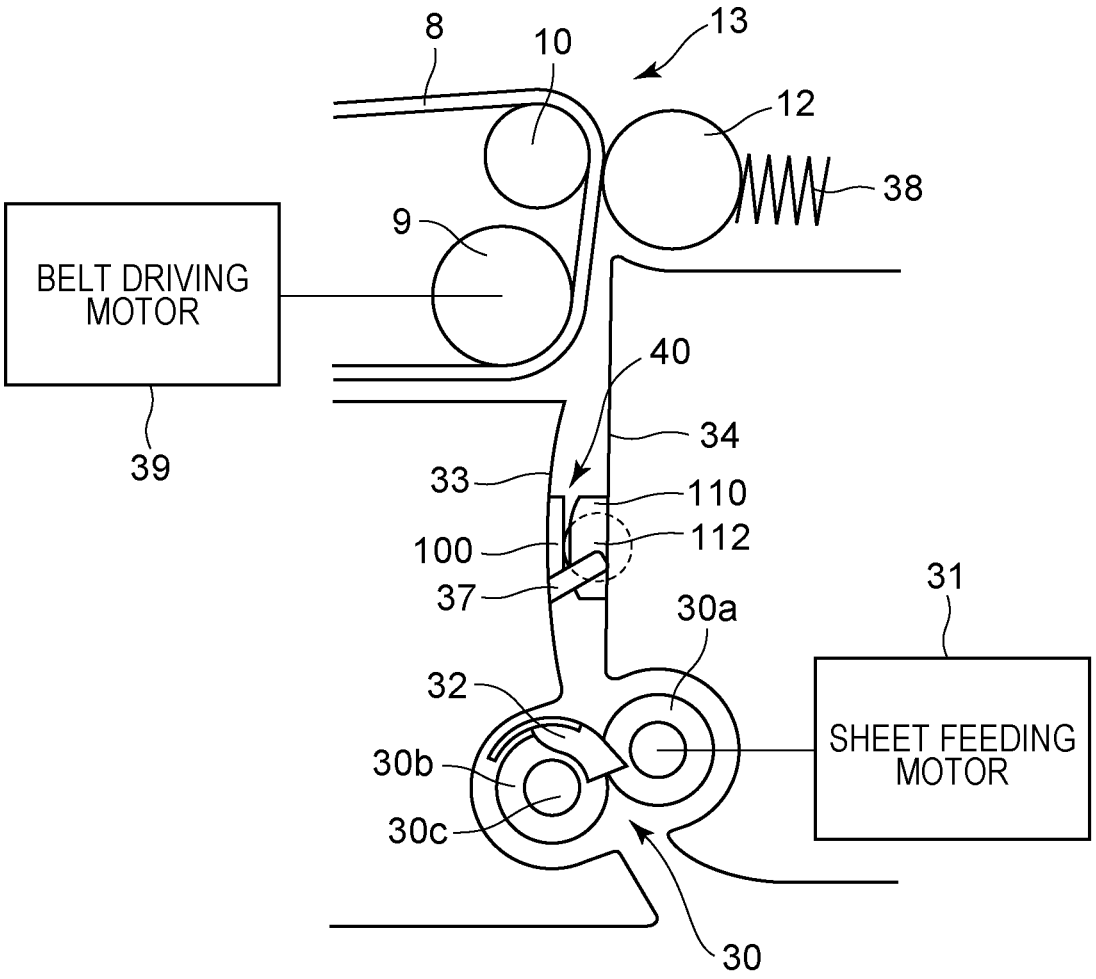
FIG. 2 is a diagram illustrating a detailed configuration of a registration roller pair and a secondary transfer conveying unit and a driving source.

FIG. 2 is a diagram illustrating a detailed configuration of the conveying path between the registration roller pair 30 and the secondary transfer conveying unit 13 and driving sources of the conveying units. The registration roller pair 30 includes a registration roller 30*a* and a registration pressure roller 30*b*. The registration pressure roller 30*b* presses the registration roller 30*a* by a spring, not illustrated, to form a nip portion. The registration pressure roller 30*b* is supported in a rotatable manner with a registration pressure roller shaft 30*c* at a center. The registration roller 30*a* is rotated by a driving force supplied from a sheet feeding motor 31 to convey the sheet S. Note that the conveyance controller 61 controls the sheet feeding motor 31 to change a speed for conveying the sheet S by the registration roller pair 30.

A registration shutter 32 which corrects skew of the sheet S is disposed on an upstream side of the registration roller pair 30 in a conveying direction of the sheet S. The registration shutter 32 is supported in a rotatable manner with the registration pressure roller shaft 30*c* at the center and is urged by a spring, not illustrated, in a clockwise direction of FIG. 2. When a leading end of the sheet S enters the registration shutter 32, the registration shutter 32 is rotated in the counterclockwise direction of FIG. 2 against the urged force. When the sheet S skews, the sheet S is uniformly in contact with the registration shutter 32 in a width direction to push up the registration shutter 32, and thereafter, is conveyed to the registration roller pair 30. Specifically, the leading end of the sheet S abuts on the registration shutter 32 so that the skew of the sheet S is corrected.

As described above, the secondary transfer conveying unit 13 includes the intermediate transfer belt 8, the secondary transfer counter roller 10, and the secondary transfer roller 12. When a secondary transfer roller pressing spring 38 presses the secondary transfer roller 12 against the secondary transfer counter roller 10 so that a nip portion for conveying the sheet S is formed on the intermediate transfer belt 8. The driving roller 9 rotates when receiving a driving force from a belt driving motor 39 and drives the intermediate transfer belt 8 in the counterclockwise direction of FIG. 2. Note that the conveyance controller 61 described above controls the belt driving motor 39.

Furthermore, a pre-transfer inner guide 33 and a pre-transfer outer guide 34 form a conveying path which guides the sheet S from the registration roller pair 30 to the secondary transfer conveying unit 13. The sensor guide unit 40 includes a first sensor holder 100 (a first contacting member) which contacts with one surface of the conveyed sheet S and a second sensor holder 110 (a second contacting member) which contacts with the other surface of the sheet S. The first sensor holder 100 is disposed on the pre-transfer inner guide 33 and the second sensor holder 110 is disposed on the pre-transfer outer guide 34. The first sensor holder 100 is urged to press the second sensor holder 110 and is movable relative to the pre-transfer inner guide 33. The second sensor holder 110 is urged to press the first sensor holder 100 and is movable relative to the pre-transfer outer guide 34. The first sensor holder 100 and the second sensor holder 110 urge each other to nip the conveyed sheet S. A driven roller 112 is disposed on the second sensor holder 110 and abuts on the first sensor holder 100. When the sheet S passes the sensor guide unit 40, the driven roller 112 is in contact with the sheet S and is rotated so that conveyance resistance of the sheet S is reduced. A loop sensor flag 37 detects an amount of loop of the sheet S by loop control described below.

In this embodiment, the sheet S is conveyed in the nip portion of the registration roller pair 30 in a left oblique direction of FIG. 2. Similarly, the sheet S is conveyed in the nip portion of the secondary transfer conveying unit 13 in a right oblique direction of FIG. 2. Since the conveying directions of the sheet S are determined, a direction of a loop of the sheet S in a portion between the registration roller pair 30 and the secondary transfer conveying unit 13 is limited to a side of the pre-transfer inner guide 33 (a left side in FIG. 2). A conveying guide of the pre-transfer inner guide 33 is curved to form a space serving as a loop region.

Figure 3A:
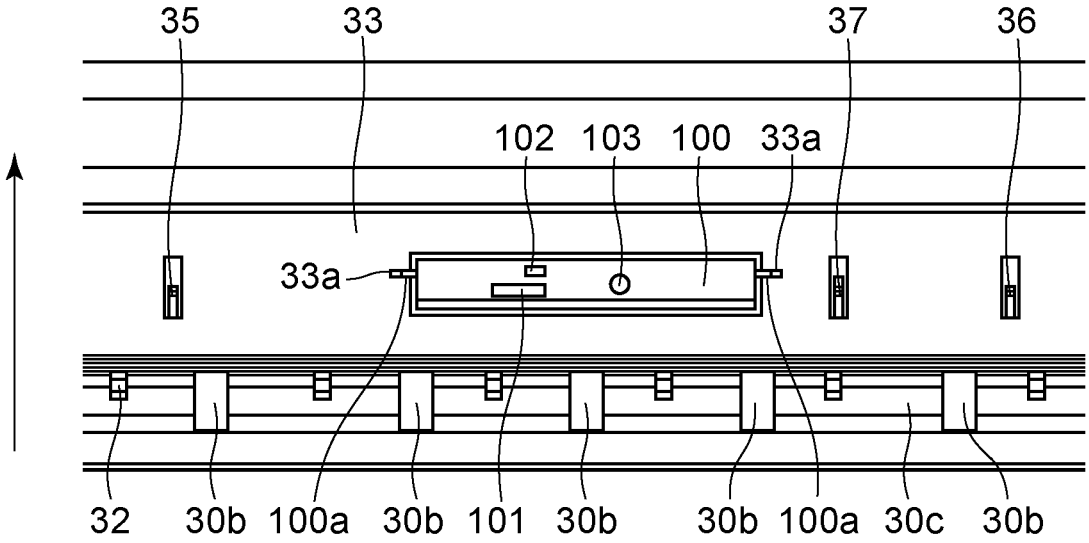
FIGS. 3A and 3B are diagrams illustrating arrangement of members of a pre-transfer inner guide and a pre-transfer outer guide in a longitudinal direction.
Figure 3B:
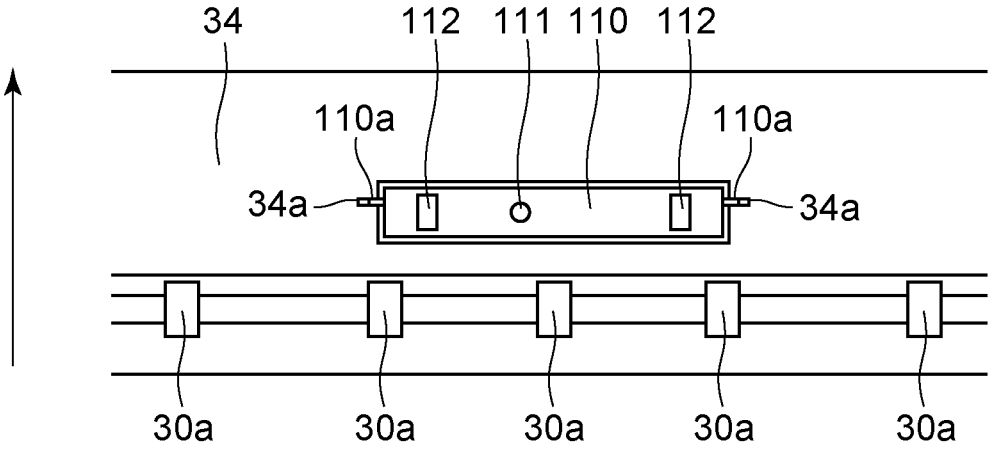

FIG. 3A is a diagram illustrating arrangement the members disposed in the pre-transfer inner guide 33 in a longitudinal direction (the width direction of the sheet S), and FIG. 3B is a diagram illustrating arrangement of the members disposed in the pre-transfer outer guide 34 in a longitudinal direction. Here, the sheet S is conveyed in arrow directions in FIGS. 3A and 3B by the registration roller pair 30 (the registration roller 30*a* and the registration pressure roller 30*b*).

First, FIG. 3A will be described. The pre-transfer inner guide 33 includes sheet width sensor flags 35 and 36 which detect a width of the sheet S and a loop sensor flag 37 which detects a width of the sheet S and a loop. Specifically, the loop sensor flag 37 is used not only to detect a loop amount of the sheet S but also to detect a width of the sheet S. The pre-transfer inner guide 33 further includes photo-interrupters (refer to FIGS. 5A to 5C) which correspond to the respective flags and which detect a width of the sheet S by an ON/OFF state of the photo-interrupters.

The first sensor holder 100 has projection portions 100*a* at opposites ends thereof in a longitudinal direction, and the pre-transfer inner guide 33 has grove portions 33*a* for the projection portions 100*a*. The projection portions 100*a* engaged with the respective grove portions 33*a*. When the projection portions 100*a* move along the grove portions 33*a*, the first sensor holder 100 may move relative to the pre-transfer inner guide 33. The first sensor holder 100 includes a line sensor 101 (a light reception unit) and a light emission diode (LED) 102 (a light emission unit) which constitute a surface property detection unit and includes an ultrasonic reception unit 103 which constitutes a basis weight detection unit.

The surface property detection unit detects a surface property of the sheet S, that is, a roughness state of the surface, as information on a property of the sheet S. When the surface property is to be detected, light emitted by the LED 102 is polarized by a polarizer, not illustrated, and the polarized light is incident on the surface of the sheet S in an oblique direction. The light reflected on the surface of the sheet S is collected and the line sensor 101 performs imaging. The line sensor 101 is an imaging element which extends along the width direction of the sheet S and performs imaging a plurality of times while the sheet S is conveyed. The image controller 62 described above obtains a feature value associated with the surface property from images of the surface of the sheet S obtained as described above and determines the surface property (a type) of the sheet S.

Second, FIG. 3B will be described. The second sensor holder 110 has projection portions 110*a* at opposites ends thereof in a longitudinal direction, and the pre-transfer outer guide 34 has grove portions 34*a* for the projection portions 110*a*. The projection portions 110*a* engaged with the respective grove portions 34*a*. When the projection portions 110*a* move along the grove portions 34*a*, the second sensor holder 110 may move relative to the pre-transfer outer guide 34. The second sensor holder 110 includes an ultrasonic transmission unit 111 and the two driven rollers 112 which constitute the basis weight detection unit.

The basis weight detection unit detects a basis weight of the sheet S as information on a property of the sheet S. Here, the basis weight is quantity of the sheet S per unit area and a unit thereof is [g/m$^2$]. The ultrasonic transmission unit 111 and the ultrasonic reception unit 103 are disposed to face each other with the conveying path of the sheet S therebetween. When the basis weight is to be detected, an ultrasonic wave transmitted from the ultrasonic transmission unit 111 propagates in the air and reaches the sheet S. When the ultrasonic wave reaches the sheet S, the sheet S is vibrated by the ultrasonic wave. The ultrasonic wave is attenuated in accordance with the basis weight of the sheet S and is received by the ultrasonic reception unit 103. In this way, the ultrasonic wave generated by the ultrasonic transmission unit 111 reaches the ultrasonic reception unit 103 through the sheet S. The ultrasonic reception unit 103 outputs a voltage value in accordance with an amplitude value of the received ultrasonic wave, and the image controller 62 determines a basis weight (a type) of the sheet S based on the output voltage.

The image controller 62 determines a type of the sheet S in accordance with results of the detections obtained by the surface property detection unit and the basis weight detection unit and controls a condition for forming an image on the sheet S. The image forming condition includes a conveying speed of the sheet 5, a transfer voltage to be applied to the secondary transfer roller 12 when an image is transferred on the sheet S, and a fixing temperature and a pressure to be applied of the fixing unit 51 when an image is fixed on the sheet S. For example, a coated sheet has a resistance value lower than that of a bond sheet, and therefore, a higher transfer voltage is required to be set when a toner image is transferred. Furthermore, a fixing temperature of the coated sheet which is required to fix a toner image is lower than that of the bond sheet, and a required period of time for fixing is also shorter than that of the band sheet. Therefore, different fixing conditions including a fixing temperature and a conveying speed of a sheet S are required for the coated sheet and the bond sheet. In this way, by controlling various image forming conditions, quality of an image formed on the sheet S may be refined.

Figure 4A:
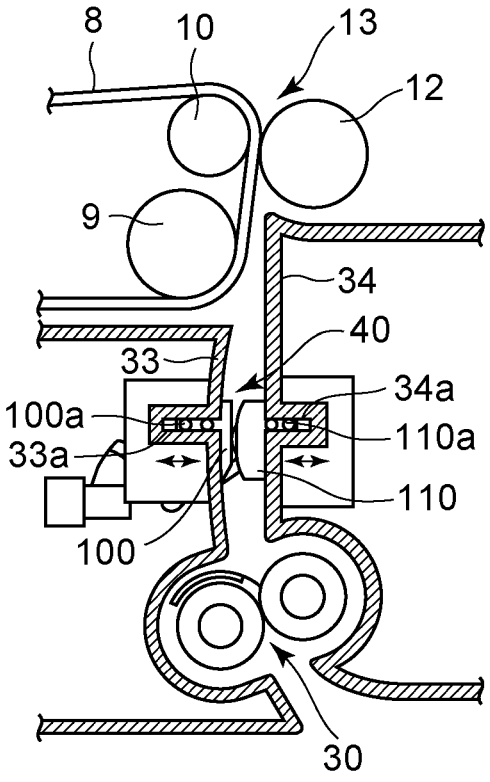
FIGS. 4A and 4B are cross-sectional views of a configuration of a sensor guide unit.
Figure 4B:
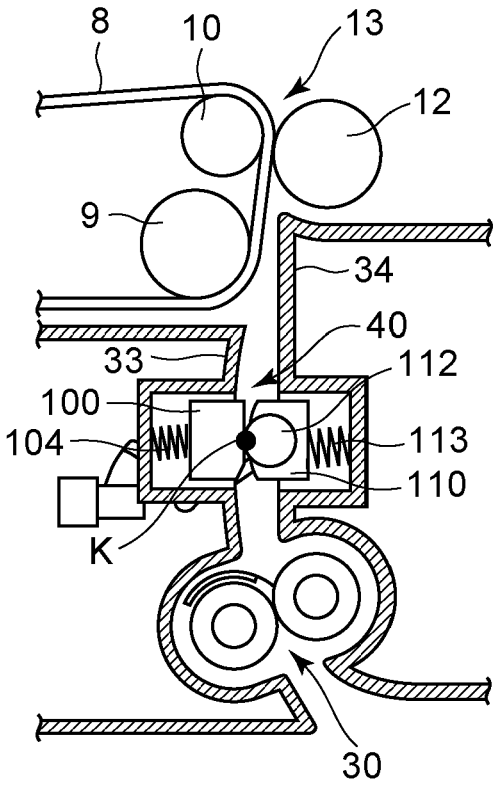

FIGS. 4A and 4B are cross sectional views illustrating the sensor guide unit 40 in detail. FIG. 4A is a diagram illustrating a position holding configuration of the first sensor holder 100 and the second sensor holder 110, and FIG. 4B is a diagram illustrating a pressing configuration of the first sensor holder 100 and the second sensor holder 110.

First, FIG. 4A will be described. The grove portions 33*a* of the pre-transfer inner guide 33 are formed in a lateral direction of FIG. 4A, and the two projection portions 100*a* of the first sensor holder 100 are engaged with the grove portions 33*a*. By this, the first sensor holder 100 is movable in an arrow direction in FIG. 1A relative to the pre-transfer inner guide 33. The first sensor holder 100 is similarly configured such that the grove portions 34*a* of the pre-transfer outer guide 34 are formed in a lateral direction of FIG. 4A, and the two projection portions 110*a* of the second sensor holder 110 are engaged with the grove portions 34*a*. By this, the second sensor holder 110 is movable in an arrow direction in FIG. 4A relative to the pre-transfer outer guide 34.

Second, FIG. 4B will be described. The first sensor holder 100 is urged by a first holder spring 104 which is a compression spring to press the second sensor holder 110. Furthermore, the second sensor holder 110 is urged by a second holder spring 113 which is a compression spring to press the first sensor holder 100. The driven roller 112 abuts on the first sensor holder 100. In this way, the first sensor holder 100 and the second sensor holder 110 press each other and stop in a position in which pressing forces are balanced. The position in which the pressing forces are balanced is determined as a balance point K. The urging forces of the first holder spring 104 and the second holder spring 113 are set such that the balance point K is included in the loop region formed by the pr-transfer inner guide 33 and the pre-transfer outer guide 34.

Since the first sensor holder 100 and the second sensor holder 110 press each other and abut on each other to nip the sheet 5, a distance between the surface property detection unit or the basis weight detection unit and the sheet S may be maintained constant. Therefore, influence of the flapping of the sheet S in conveyance may be reduced and degradation of detection accuracy of the surface property detection unit and the basis weight detection unit may be suppressed. Furthermore, since stiffness of a thin sheet S and stiffness of a thick sheet S are different from each other, if leading ends of the sheets S pass different conveyance paths, the sensor guide unit 40 operates in accordance with positions of the sheets S. Therefore, influence of different stiffness of the sheets S may be reduced and degradation of the detection accuracy of the surface property detection unit and the basis weight detection unit may be suppressed.

Figure 5A:
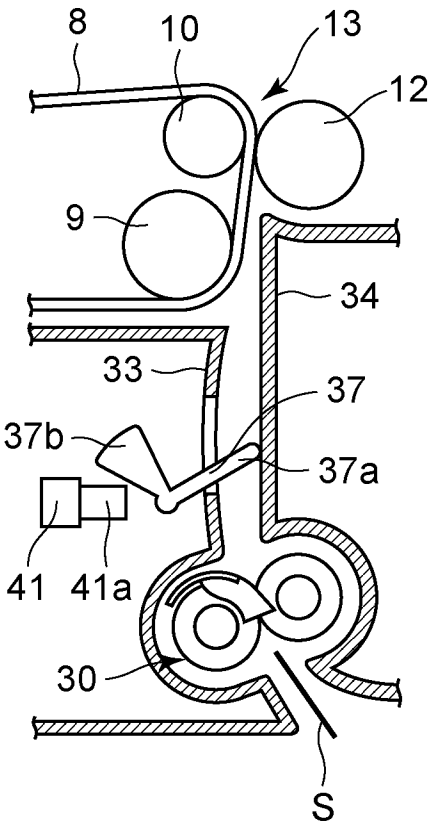
FIGS. 5A to 5C are cross-sectional views of a configuration of a registration loop sensor.
Figure 5B:
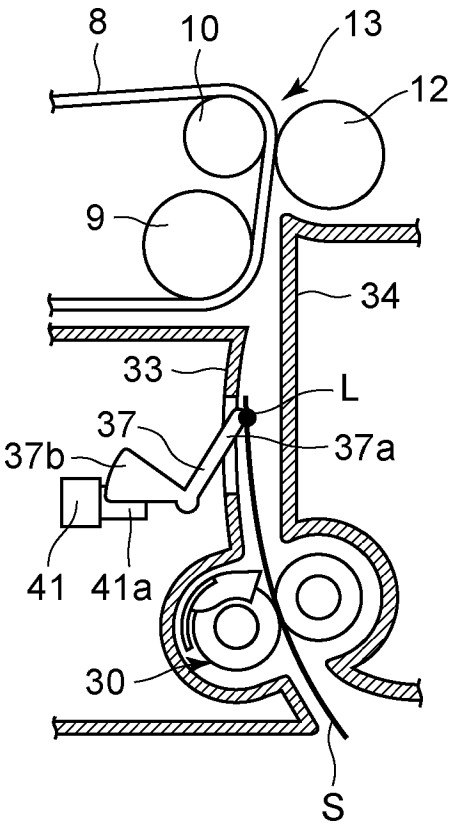
Figure 5C:
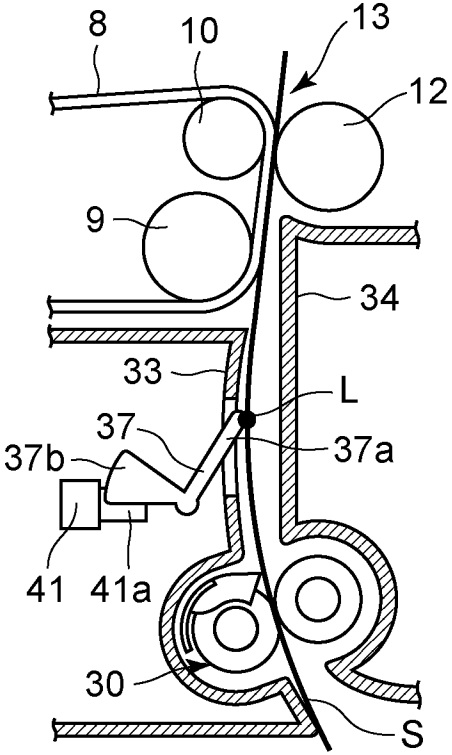

FIGS. 5A to 5C are cross-sectional views illustrating the loop sensor flag 37 which performs the registration loop control in detail. A waiting state of a sheet S is illustrated in FIG. 5A, a state in which the sheet S has reached the loop sensor flag 37 is illustrated in FIG. 5B, and a state in which the sheet S is being conveyed by the registration roller pair 30 and the secondary transfer conveying unit 13 is illustrated in FIG. 5C.

First, FIG. 5A will be described. The loop sensor flag 37 is disposed between the registration roller pair 30 and the secondary transfer conveying unit 13. The loop sensor flag 37 has the pre-transfer inner guide 33 at the center thereof and is disposed in a rotatable manner. The loop sensor flag 37 is pressed by a torsion coil spring, not illustrated, in a clockwise direction of FIG. 5A. The loop sensor flag 37 includes a sheet detection portion 37*a* and a light shielding portion 37*b*. A registration loop sensor 41 includes a photo-interrupter. When the light shielding portion 37*b* of the loop sensor flag 37 shields light of a photo-interrupter 41*a*, the registration loop sensor 41 outputs an ON signal (a first output value) and when the light shielding portion 37*b* allows light to pass, the registration loop sensor 41 outputs an OFF signal (a second output value). In the waiting state of the sheet S illustrated in FIG. 5A, the registration loop sensor 41 outputs an OFF signal.

When the sheet S is conveyed by the registration roller pair 30 and reached the loop sensor flag 37 (FIG. 5B), the sheet S pushes up the loop sensor flag 37 and the light shielding portion 37*b* shields light from the photo-interrupter 41*a*. A position of the loop sensor flag 37 at a start of the light shielding is determined as a registration loop control point L. When the sheet S is further conveyed to a downstream side and reaches the secondary transfer conveying unit 13 (FIG. 5C), the registration loop control is started so that an amount of a loop of the sheet S is maintained constant between the registration roller pair 30 and the secondary transfer conveying unit 13. The loop sensor flag 37 and the registration loop sensor 41 are disposed such that the registration loop control point L is included in the loop region formed by the pre-transfer inner guide 33 and the pre-transfer outer guide 34.

Figure 6:
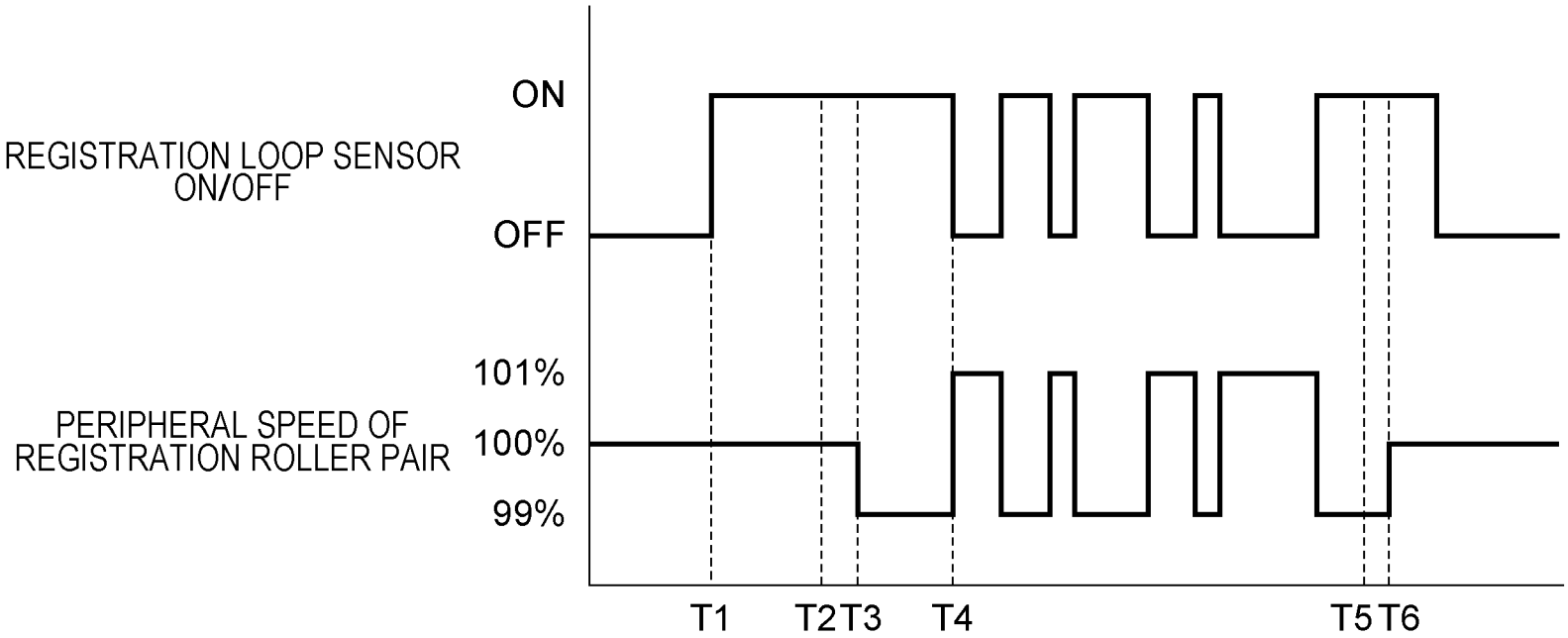
FIG. 6 is a diagram illustrating a change of an output signal of the registration loop sensor and a change of a peripheral speed of the registration roller pair at a time of registration loop control.

FIG. 6 is a graph of an example of an operation of the registration loop control. An upper side in the graph indicates a signal (ON/OFF) output from the registration loop sensor 41. A lower side in the graph indicates a rate of a speed of conveyance of the sheet S by the registration roller pair 30 (a peripheral speed of the registration roller pair 30) to a speed of conveyance of the sheet S by the secondary transfer conveying unit 13. Here, the speed of conveyance of the sheet S by the secondary transfer conveying unit 13 corresponds to a peripheral speed of the intermediate transfer belt 8. A case where the peripheral speed of the intermediate transfer belt 8 coincides with the peripheral speed of the registration roller pair 30 is represented by "100%" in FIG. 6. Note that the peripheral speed of the intermediate transfer belt 8 is not changed during image formation.

At a time point T1, the leading end of the sheet S pushes up the loop sensor flag 37 and the registration loop sensor 41 outputs an ON signal. At a time point T2, the leading end of the sheet S reaches the secondary transfer conveying unit 13. At a time point T3, the registration loop control is started. The registration loop control is started after the leading end of the sheet S reaches the secondary transfer conveying unit 13.

In FIG. 6, the registration loop sensor 41 outputs an ON signal at the time point T3, and therefore, an amount of a loop of the sheet S is large. Accordingly, the conveyance speed of the registration roller pair 30 is reduced so that the loop amount is reduced, that is, the sheet S is moved toward the pre-transfer outer guide 34. In this embodiment, the conveyance controller 61 controls the sheet feeding motor 31 so that a peripheral speed of the registration roller pair 30 corresponds to 99%.

At a time point T4, the registration loop sensor 41 outputs an OFF signal. In this case, the conveyance speed of the registration roller pair 30 is increased so that the loop amount is increased, that is, the sheet S is moved toward the pre-transfer inner guide 33. In this embodiment, the conveyance controller 61 controls the sheet feeding motor 31 so that a peripheral speed of the registration roller pair 30 corresponds to 101%. In this way, the conveyance controller 61 (a loop controller) changes a speed of the sheet feeding motor 31 in accordance with the signal (ON/OFF) output from the registration loop sensor 41 so that an amount of loop of the sheet S may be maintained constant in a position near the registration loop control point L.

A time point T5 is a timing immediately before a trailing end of the sheet S passes the registration roller pair 30, and a time point T6 is a timing when the trailing end of the sheet S has passed the registration roller pair 30. In this embodiment, the conveyance speed of the registration roller pair 30 is set to 99% during the time points T5 to T6. This setting is performed to avoid a phenomenon in which, if the trailing end of the sheet S passes the registration roller pair 30 when a loop amount is large, the sheet S flaps due to slack of the loop, and accordingly, the sheet S is in contact with the intermediate transfer belt 8 and rubbed by the intermediate transfer belt 8. The setting of the conveyance speed of the registration roller pair 30 returns to 100% after the time point T6, and a timing when a next sheet enters the registration roller pair 30 is waited.

A large torque load applied to the secondary transfer conveying unit 13 causes a color shift among colors. Since the constant loop is maintained in the registration loop control point L as described above, the sheet S is prevented from being pushed or pulled in an excessive amount in a position between the registration roller pair 30 and the secondary transfer conveying unit 13. By this, the torque load applied to the secondary transfer conveying unit 13 is reduced.

Note that the speed in the time points T5 to T6 may be changed in accordance with a thickness of the sheet S or a shape of the conveying path. For example, if the sheet S is excessively extracted in a position between the secondary transfer conveying unit 13 and the registration roller pair 30, a blur image may be generated in the secondary transfer conveying unit 13 due to shock when the trailing end has passed the registration roller pair 30. In this case, the conveyance speed of the registration roller pair 30 may be increased so that a loop is generated, and accordingly, the generation of the blur image may be avoided. Furthermore, a change of a speed increase rate or a speed reduction rate of the peripheral speed of the registration roller pair 30 may be performed based on a result of the detection of the sensor guide unit 40 or a change of the peripheral speed may be performed in accordance with endurance abrasion of the registration roller pair 30.

Figure 7:
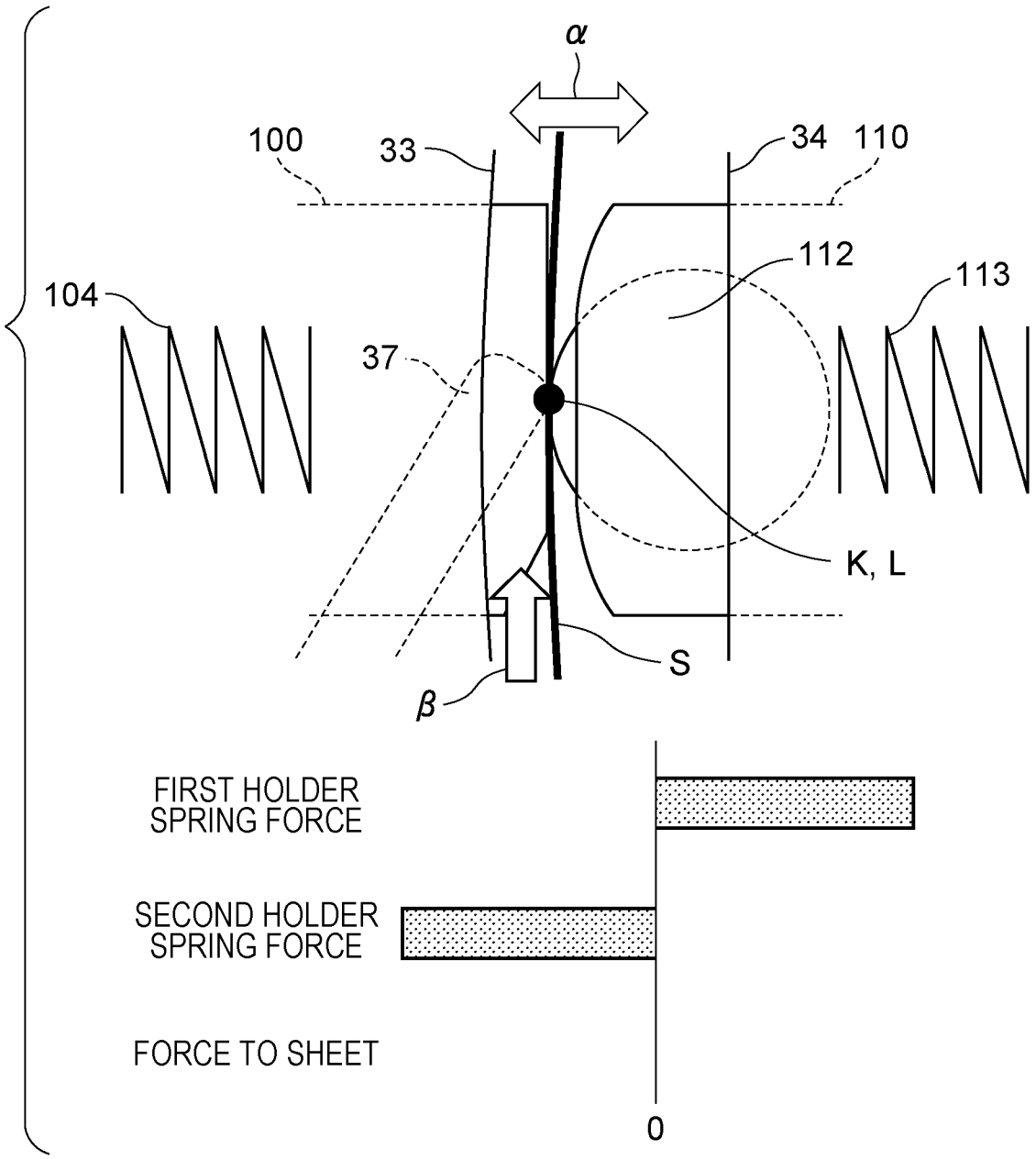
FIG. 7 is a diagram, illustrating the relationship between a state of the sensor guide unit and a force applied to a sheet when the sheet is conveyed in a balance point.
Figure 8:
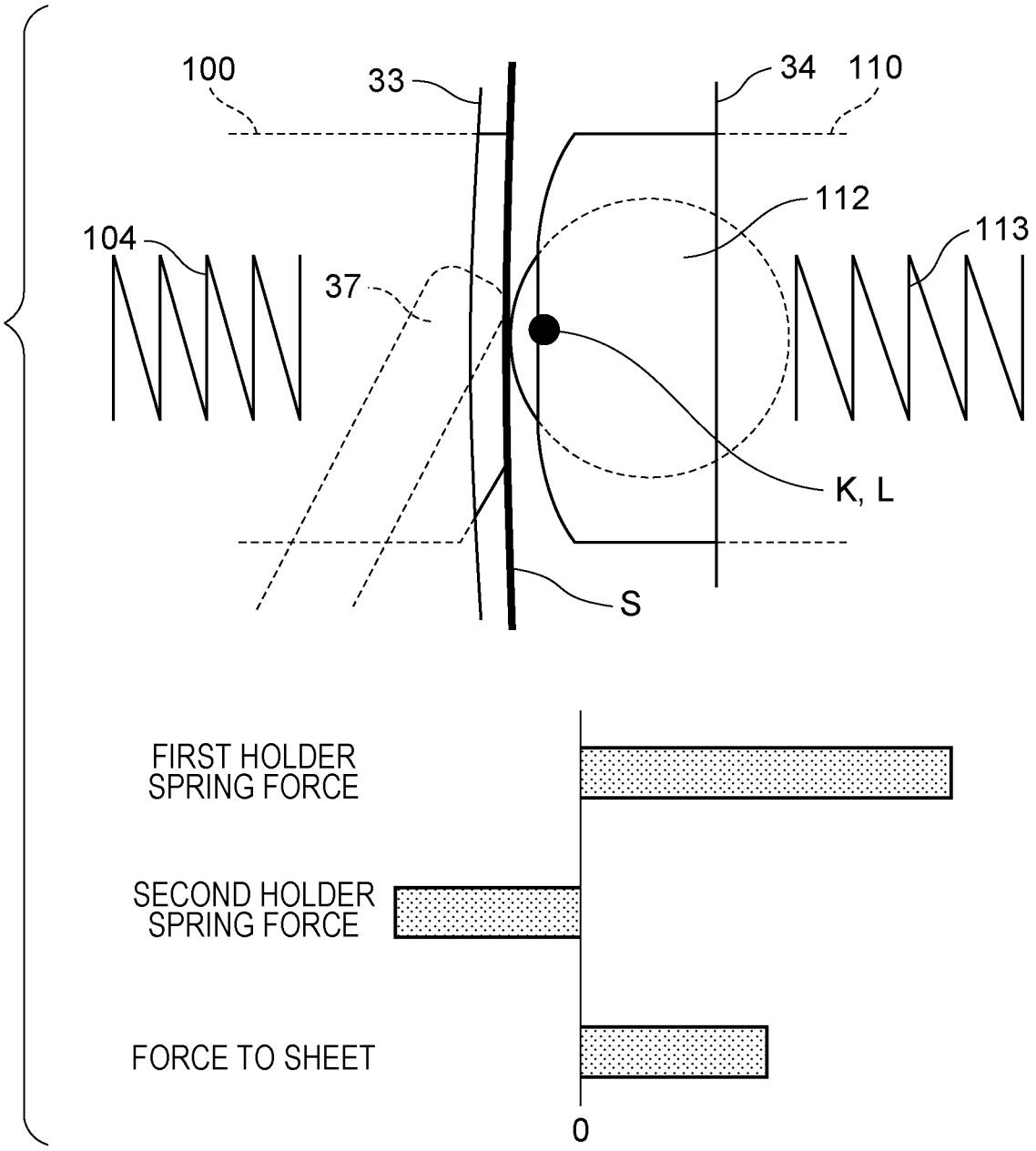
FIG. 8 is a diagram illustrating the relationship between a state of the sensor guide unit and a force applied to a sheet when an amount of loop of the sheet is large.
Figure 9:
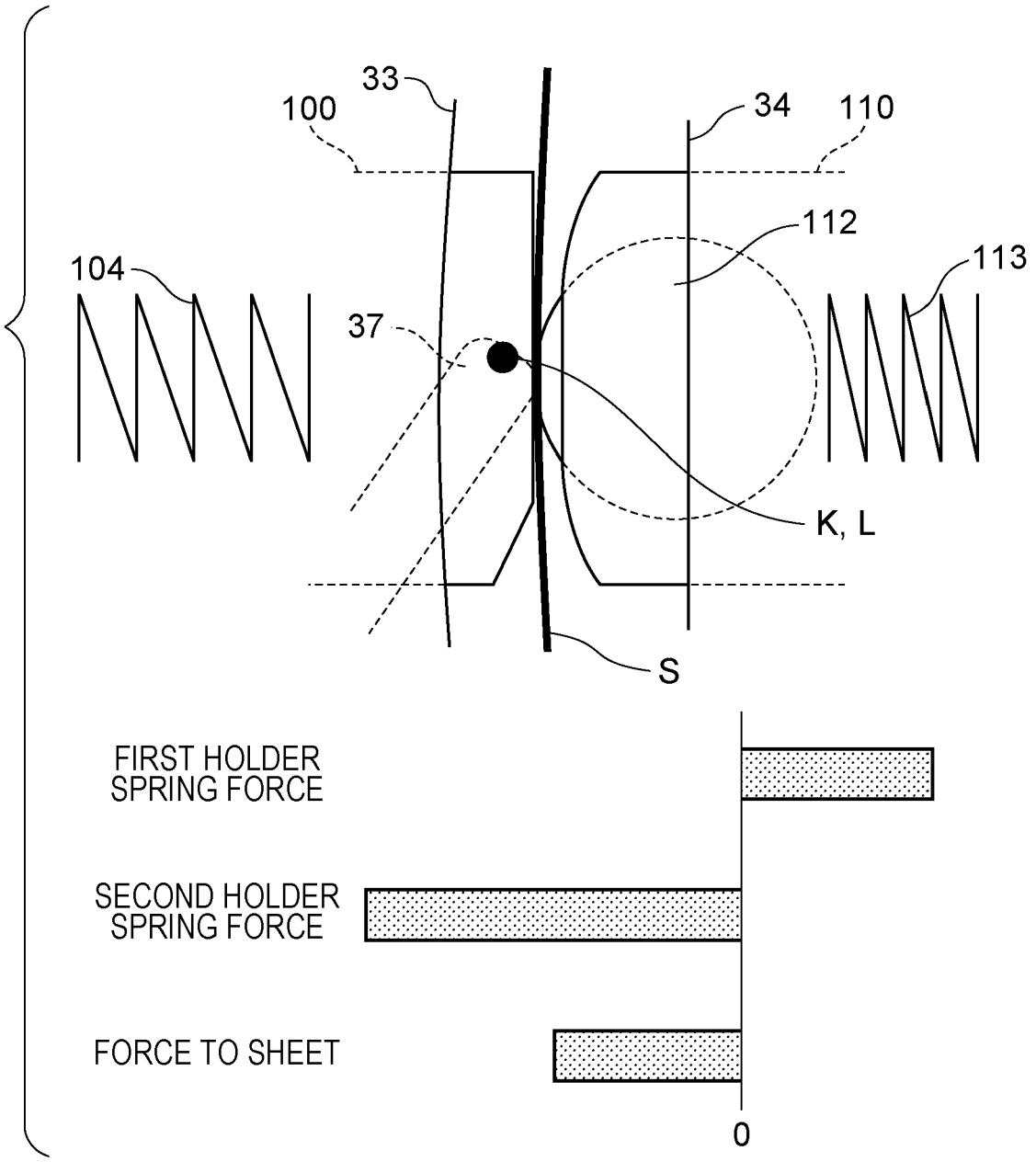
FIG. 9 is a diagram illustrating the relationship between a state of the sensor guide unit and a force applied to a sheet when an amount of loop of the sheet is small.

FIGS. 7 to 9 are cross-sectional views in a state in which the registration loop control point L and the balance point K of the sensor guide unit 40 are in the same position and diagrams illustrating forces applied by the first holder spring 104 and the second holder spring 113 to the sheet S and forces finally applied by the springs to the sheet S. FIGS. 7 to 9 are diagrams in a state in which the sensor guide unit 40 is viewed in a direction orthogonal to a direction of a parallel movement of the sensor guide unit 40 and orthogonal to the conveying direction of the sheet S. Specifically, the sensor guide unit 40 is movable in a direction indicated by an arrow α in FIG. 7, and the sheet S is conveyed in a direction indicated by an arrow β.

A state in which the sheet S is conveyed in the balance point K of the sensor guide unit 40 is illustrated in FIG. 7. In FIG. 7, a force of the first holder spring 104 (a first urging member) which presses the sheet S rightward of FIG. 7 through the first sensor holder 100 is equal to a force of the second holder spring 113 (a second urging member) which presses the sheet S leftward of FIG. 7 through the second sensor holder 110. Therefore, a force received by the sheet S from the sensor guide unit 40 is zero, and accordingly, the conveyance of the sheet S is not affected. Accordingly, if the registration loop control point L is positioned in the balance point of the sensor guide unit 40, the registration loop control may be performed without influence of the sensor guide unit 40.

Next, influence of the sensor guide unit 40 to the sheet S when the registration loop control is performed and an operation will be described with reference to FIGS. 8 and 9.

FIG. 8 is a diagram illustrating a state in which the sheet S is conveyed in a position on a left side relative to the balance point K of the sensor guide unit 40. This state means a larger loop amount of the sheet S when compared with the state of FIG. 7. In FIG. 8, a force of the first holder spring 104 which presses the sheet S rightward is larger than that in the state of FIG. 7 since the first holder spring 104 is compressed. On the other hand, a force of the second holder spring 113 which presses the sheet S leftward is smaller than that in the state of FIG. 7 since the second holder spring 113 stretches. Therefore, a force received by the sheet S from the sensor guide unit 40 is directed rightward, that is, toward the registration loop control point L.

As illustrated in FIG. 8, when the sheet S is disposed on a left side relative to the registration loop control point L, the registration loop sensor 41 outputs an ON signal, and therefore, the conveyance controller 61 controls the sheet feeding motor 31 to reduce a peripheral speed of the registration roller pair 30. Therefore, the sheet S intends to move rightward. In this case, since the force received from the sensor guide unit 40 also is directed rightward, the force assists an operation of cancelling a loop of the sheet S.

FIG. 9 is a diagram illustrating a state in which the sheet S is conveyed in a position on a right side relative to the balance point K of the sensor guide unit 40. This state means a smaller loop amount of the sheet S when compared with the state of FIG. 7. In FIG. 9, a force of the first holder spring 104 which presses the sheet S rightward is smaller than that in the state of FIG. 7 since the first holder spring 104 is stretched. On the other hand, a force of the second holder spring 113 which presses the sheet S leftward is larger than that in the state of FIG. 7 since the second holder spring 113 compressed. Therefore, a force received by the sheet S from the sensor guide unit 40 is directed leftward, that is, toward the registration loop control point L.

As illustrated in FIG. 9, when the sheet S is disposed on a right side relative to the registration loop control point L, the registration loop sensor 41 outputs an OFF signal, and therefore, the conveyance controller 61 controls the sheet feeding motor 31 to increase the peripheral speed of the registration roller pair 30. Therefore, the sheet S intends to move leftward. In this case, since the force received from the sensor guide unit 40 is also directed leftward, the force assists an operation of increasing a loop of the sheet S.

In this way, since the registration loop control point L and the balance point K of the sensor guide unit 40 coincide with each other, a load is not applied to the sheet S when the sheet S is conveyed in the registration loop control point L. Therefore, loop control which is the same as that performed without the sensor guide unit 40 may be realized. Furthermore, when a loop is increased or when an operation of cancelling a loop is performed, the sensor guide unit 40 assists a registration loop control operation so that the number of times an ON state and an OFF state are switched from one to another in the loop control may be increased. When the number of times an ON state and an OFF state are switched from one to another is increased, an amount of a loop of the sheet S may be maintained constant since the sheet S is conveyed in a portion in the vicinity of the registration loop control point L. Specifically, an orientation of the sheet may be stabled and generation of an image defect in the secondary transfer conveying unit 13 may be reduced.

According to this embodiment, the loop control may be executed with high accuracy between two the conveying units, and degradation of accuracy of a detection of the sheet S by a medium sensor disposed between the two conveying units may be suppressed.

Note that, although the configuration in which the balance point K of the sensor guide unit 40 coincides with the registration loop control point L is described in the embodiment described above, the present disclosure is not limited to this. Any configuration may be employed as long as the registration loop control point L is included in a range M including the balance point K in which the sensor guide unit 40 is movable.

Figure 10:
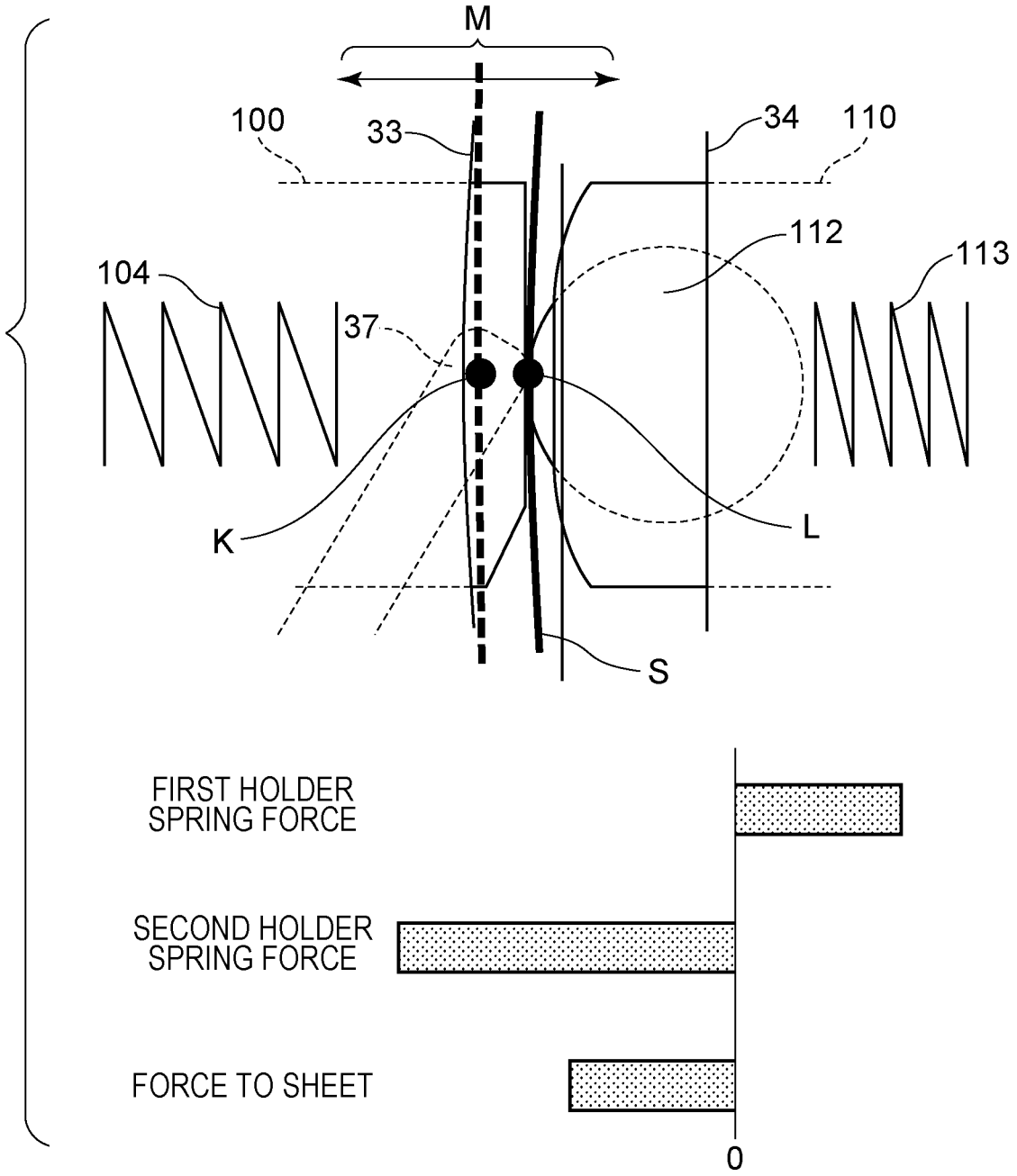
FIG. 10 is a diagram illustrating the relationship between a state of the sensor guide unit and a force applied to a sheet when the balance point and a registration loop control point are shifted from each other.

FIG. 10 is a diagram illustrating a case where the balance point K of the sensor guide unit 40 is positioned on a left side relative to the registration loop control point L. In FIG. 10, the movable range M of the sensor guide unit 40 includes the registration loop control point L. Note that the movable range M of the sensor guide unit 40 is determined based on spring constants of the first holder spring 104 and the second holder spring 113 with the balance point K at a center. In this embodiment, the movable range M is a region of ±3 mm including the balance point K at the center.

As illustrated in FIG. 10, when the balance point K is positioned on the left side relative to the registration loop control point L, a force applied to the sheet S at the registration loop control point L is not zero but a force for pressing the sheet S leftward is generated. When this force is increased, an extra force is required for pressing the sheet S rightward, that is, for cancelling a loop. Force for cancelling a loop is generated by a tension three of the secondary transfer conveying unit 13 and the registration roller pair 30, and therefore, an increased torque load of the secondary transfer conveying unit 13 affects color shift or the like. Therefore, the influence to the torque load to the secondary transfer conveying unit 13 is reduced by reducing the spring constants of the first holder spring 104 and the second holder spring 113 as small as possible.

In this way, the balance point K and the registration loop control point L may be shifted from each other taking balance with the influence to the secondary transfer conveying unit 13 into consideration even if the balance point K of the sensor guide unit 40 does not coincide with the registration loop control point L.

Furthermore, although only the loop sensor flag 37 disposed at a center in a plurality of sheet width sensor flags is used for the registration loop control in the embodiment described above, a flag disposed in another position may be used for the registration loop control.

For example, a sheet width sensor flag 35 illustrated in FIG. 3A may be used as a loop sensor for thick sheets and the loop sensor flag 37 may be used as a loop sensor for plain sheets and thin sheets. Here, a position where the sheet width sensor flag 35 blocks light from the photo-interrupter and a position where the loop sensor flag 37 blocks light from the photo-interrupter 41*a* may be shifted from each other taking difference of stiffness among the thick sheets, the plain sheets, and the thin sheets into consideration. Specifically, the position where the loop sensor flag 37 blocks light from the photo-interrupter 41*a* corresponds to a position of the balance point K as illustrated in FIG. 7, and the position where the sheet width sensor flag 35 blocks light from the photo-interrupter is nearer to the pre-transfer outer guide 34 relative to the balance position K.

Figure 11:
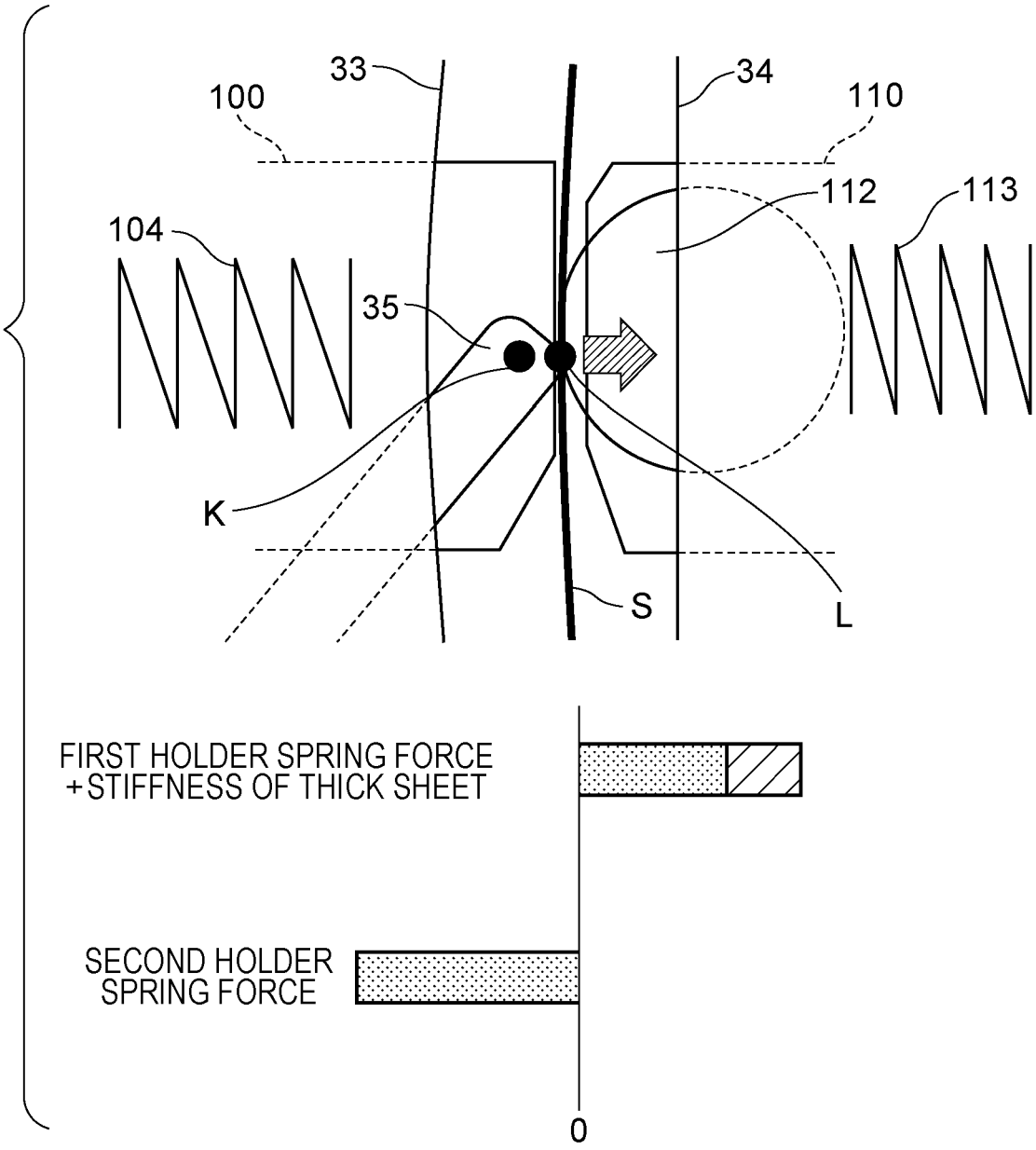
FIG. 11 is a diagram illustrating the relationship between a balance point and a registration loop control point in a case of a thick sheet.

FIG. 11 is a diagram illustrating a state in which the sheet width sensor flag 35 is used as a loop sensor for thick sheets and the registration loop control point L is shifted on a right side in FIG. 11 relative to the balance point K. In a case where a conveying path is configured such that a nip direction of the registration roller pair 30 corresponds to a direction of the pre-transfer inner guide 33 and the sheet S is curved, if a thick sheet is to be curved, the thick sheet tends to return to a straight state due to its stiffness. Specifically, a force caused by the stiffness of the thick sheet is applied to the second sensor holder 110 of FIG. 11. Therefore, in a case where the conveying path which is affected by the stiffness of a thick sheet is configured, the registration loop control point L is shifted on the second sensor holder 110 side relative to the balance point K taking the influence of the force caused by the stiffness of thick sheet into consideration. As the force relationship in the registration loop control point L, since the registration loop control point L is on the right side relative to the balance point K as illustrated in FIG. 11, a force received by the sheet S from the first holder spring 104 is small and a force received by the sheet S from the second holder spring 113 is large. However, a force of the stiffness of the thick sheet is farther added to the force of the first holder spring 104, and as a result, the forces are balanced in the registration loop control point L.

In this way, sheets S which are less affected by the stiffness, such as thin sheets and plain sheets, and sheets S which are significantly affected by the stiffness, such as thick sheets, may be distinguished from each other, and the registration loop control may be performed in a plurality of positions. As a result, the registration loop control may be stable performed even on the thick sheets.

Furthermore, although a type of the sheets S is determined by detecting a surface property and a basis weight of the sheets using the surface detection unit and the basis weight detection unit, respectively, in the foregoing embodiment, only one of the detection units may be included. Furthermore, another property of the sheets S which is different from the surface property and the basis weight of the sheets S may be detected. For example, the first sensor holder 100 may include a light emitting element which emits light and the second sensor holder 110 may include a light receiving element which receives light transmitted from the sheet S so that a thickness of the sheet S may be determined in accordance with an amount of light transmitted through the sheet S. In this case, the controller 60 determines that the sheet S is a thin sheet when the amount of transmitted light is large and that the sheet S is a thick sheet when the amount of transmitted light is small.

Furthermore, although the medium sensor (the sensor guide unit 40) which detects information on the property of the sheets S is described as a sensor for detecting sheets S in the foregoing embodiment, the present disclosure is not limited to this. For example, the present disclosure may be applied to a color sensor which detects a tint of an image formed on a sheet S. Since the color sensor is disposed on a duplex conveying path in many cases, the present disclosure may be applied to a case where the loop control is executed in an interval of the duplex conveying path. A result of detection by the color sensor is fed back to the image controller 62 and is reflected to an image forming condition used in a next time onwards.

Furthermore, although a laser beam printer is illustrated as an example in the foregoing embodiment, the image forming apparatus to which the present disclosure is applied is not limited to this, and the present disclosure may be applied to printers employing other printing methods, such as an inkjet printer, or a photocopier.

While the present disclosure has been described with reference to embodiments, it is to be understood that the disclosure is not limited to the disclosed embodiments. The scope of the following claims is to be accorded the broadest interpretation to encompass all such modifications and equivalent structures and functions.

This application claims the benefit of Japanese Patent Application No. 2017-189101 filed Sep. 28, 2017 and No. 2018-148583 filed Aug. 7, 2018, which are hereby incorporated by reference herein in their entirety

What is claimed is:

1. An image forming apparatus comprising:

a first conveying unit configured to convey a recording material;

a second conveying unit configured to convey the recording material;

a flag disposed between the first and second conveying units and configured to be moved in a case where the flag is in contact with a recording material having a loop formed between the first and second conveying units;

a sensor configured to output a signal of an output value that varies depending on a position of the flag;

a loop controller configured to change a speed of conveyance of the recording material conveyed by at least one of the first and second conveying units in accordance with the signal output from the sensor;

a detector disposed between the first and second conveying units and configured to detect the recording material or an image formed on the recording material; and an image controller configured to change, in accordance with a result of the detection performed by the detector, an image forming condition to form the image on the recording material, wherein the detector includes a first contacting member configured to contact with a surface of the recording material and a second contacting member configured to contact with the other surface of the recording material and which faces the first contacting member to nip the recording material, and further includes a first urging member configured to urge the first contacting member to the second contacting member and includes a second urging member configured to urge the second contacting member to the first contacting member, wherein the first and second contacting members are movable in a direction in which the first and second contacting members nip the recording material, and a position of the flag, for changing the output value of the signal output from the sensor, is included in a range in which the first and second contacting members are movable when viewed in a direction which is orthogonal to the direction in which the first and second contacting members are movable and which is orthogonal to a conveying direction of the recording material, wherein the first contacting member and the second contacting member nip the recording material both in a case where the signal output from the sensor has a first output value and in a case where the signal output from the sensor has a second output value, and wherein (i) a position of the flag in which a value of the signal output from the sensor is changed coincides with (ii) a position in which (a) urging forces of the first and second urging members are balanced and (b) the first and second contacting members are stopped when viewed in the direction which is orthogonal to the direction in which the first and second contacting members are movable and which is orthogonal to the conveying direction of the recording material.

2. The image forming apparatus according to claim 1, wherein the second conveying unit is a transfer unit configured to transfer an image formed on an image bearing body to the recording material and is disposed on a downstream side relative to the first conveying unit in the conveying direction of the recording material, and wherein the loop controller changes a speed of conveyance of the recording material by the first conveying unit in accordance with the signal output from the sensor.

3. The image forming apparatus according to claim 2, wherein the sensor outputs a signal of the first output value when an amount of loop formed on the recording material between the first conveying unit and the transfer unit is a first size, and the loop controller reduces the speed of conveyance of the recording material by the first conveying unit in accordance with the signal of the first output value, and wherein the sensor outputs a signal of the second output value when the amount of loop formed on the recording material between the first conveying unit and the transfer unit is a second size that is smaller than the first size, and the loop controller increases the speed of conveyance of the recording material by the first conveying unit in accordance with the signal of the second output value.

4. The image forming apparatus according to claim 1, wherein the detector is configured to detect information on properties of the recording material before an image to be transferred to the recording material is formed, and wherein the image controller changes the image forming condition including the speed of conveyance of the recording material, a value of a voltage applied to a transfer unit when the formed image is transferred to the recording material, or a temperature of a fixing unit when the image transferred to the recording material is fixed on the recording material in accordance with the result of the detection performed by the detector.

5. The image forming apparatus according to claim 1, wherein the detector includes an ultrasonic wave transmission unit included in one of the first and second contacting members and includes an ultrasonic wave reception unit included in the other of the first and second contacting members, and wherein, in a case where the ultrasonic wave reception unit receives an ultrasonic wave that is transmitted by the ultrasonic wave transmission unit through the recording material, the image controller changes the image forming condition based on amplitude of the ultrasonic wave received by the ultrasonic wave reception unit.

6. The image forming apparatus according to claim 1, wherein the detector includes a light emission unit included in one of the first and second contacting members and includes a light reception unit included in the other of the first and second contacting members, and wherein, in a case where light emitted from the light emission unit is received by the light reception unit through the recording material, the image controller changes the image forming condition based on the emitted light that is received by the light reception unit.

7. The image forming apparatus according to claim 1, wherein the detector includes a light emission unit and a light reception unit which are disposed on one of the first and second contacting members, and wherein, in a case where light emitted from the light emission unit is received by the light reception unit after being reflected by the surface of the recording material, the image controller changes the image forming condition based on the reflected light that is received by the light reception unit.

8. The image forming apparatus according to claim 1, wherein the flag and the detector are aligned in the direction which is orthogonal to the direction in which the first and second contacting members are movable and which is orthogonal to the conveying direction of the recording material.

9. The image forming apparatus according to claim 1, wherein the first urging member is a spring, the second urging member is a spring, and the range in which the first and second contacting members are movable is determined based on spring constants of the first and second urging members.

10. An image forming apparatus comprising:

a first conveying unit configured to convey a recording material;

a second conveying unit configured to convey the recording material;

a flag disposed between the first and second conveying units and configured to be moved in a case where the flag is in contact with a recording material having a loop formed between the first and second conveying units;

a sensor configured to output a signal of an output value that varies depending on a position of the flag;

a loop controller configured to change a speed of conveyance of the recording material conveyed by at least one of the first and second conveying units in accordance with the signal output from the sensor;

a detector disposed between the first and second conveying units and configured to detect the recording material or an image formed on the recording material; and an image controller configured to change, in accordance with a result of the detection performed by the detector, an image forming condition to form the image on the recording material, wherein the detector includes a first contacting member configured to contact with a surface of the recording material and a second contacting member configured to contact with the other surface of the recording material and which faces the first contacting member to nip the recording material, and further includes a first urging member configured to urge the first contacting member to the second contacting member and includes a second urging member configured to urge the second contacting member to the first contacting member, wherein the first and second contacting members are movable in a direction in which the first and second contacting members nip the recording material, and a position of the flag, for changing the output value of the signal output from the sensor, is included in a range in which the first and second contacting members are movable when viewed in a direction which is orthogonal to the direction in which the first and second contacting members are movable and which is orthogonal to a conveying direction of the recording material, wherein the first contacting member and the second contacting member nip the recording material both in a case where the signal output from the sensor has a first output value and in a case where the signal output from the sensor has a second output value, wherein a light emission unit and an ultrasonic wave reception unit are disposed on the first contacting member and an ultrasonic wave transmission unit is disposed on the second contacting member, and wherein, when viewed in the direction which is orthogonal to the direction in which the first and second contacting members are movable and which is orthogonal to the conveying direction of the recording material and in a condition that the recording material exists in the first conveying unit and the second conveying unit, (i) the flag, the sensor, and the first contacting member are disposed to be on a first side of the recording material and (ii) the second contacting member is disposed to be on a second side of the recording material that is a side that is different from the first side.

11. The image forming apparatus according to claim 10, wherein the first conveying unit includes a registration roller and a registration pressure roller, and wherein, when viewed in the direction which is orthogonal to the direction in which the first and second contacting members are movable and which is orthogonal to the conveying direction of the recording material and in the condition that the recording material exists in the first conveying unit and the second conveying unit, (i) the registration pressure roller is disposed on the first side and (ii) the registration roller is disposed on the second side.

12. The image forming apparatus according to claim 10, wherein a light reception unit, which receives light emitted from the light emission unit and reflected from the recording material, is disposed on the first contacting member.

13. The image forming apparatus according to claim 10, wherein a light reception unit which receives light emitted from the light emission unit and transmitted through the recording material is disposed on the second contacting member, and wherein a plurality of registration rollers is disposed to be on the first side and a plurality of registration pressure rollers is disposed to be on the second side.

14. The image forming apparatus according to claim 10, wherein two driven rollers are disposed on the second contacting member, and wherein, when viewed in the direction which is orthogonal to the direction in which the first and second contacting members are movable and which is orthogonal to the conveying direction of the recording material, the ultrasonic wave reception unit is disposed between the two driven rollers.

15. The image forming apparatus according to claim 10, wherein the first conveying unit includes a plurality of registration rollers and a plurality of registration pressure rollers and wherein a plurality of registration rollers is disposed to be on the first side and a plurality of registration pressure rollers is disposed to be on the second side.

* * * * *